US007156617B2

(12) United States Patent
Rossman

(10) Patent No.: US 7,156,617 B2
(45) Date of Patent: Jan. 2, 2007

(54) DUAL OUTLET PORT PUMP

(75) Inventor: Christopher A. Rossman, Comstock, MI (US)

(73) Assignee: Attwood Corporation, Lowell, MI (US)

( * ) Notice: Subject to any disclaimer, the term of this patent is extended or adjusted under 35 U.S.C. 154(b) by 102 days.

(21) Appl. No.: 10/936,309

(22) Filed: Sep. 8, 2004

(65) Prior Publication Data

US 2006/0062679 A1 Mar. 23, 2006

(51) Int. Cl.
*F04B 17/00* (2006.01)

(52) U.S. Cl. ..... 415/144; 415/206

(58) Field of Classification Search ..... 415/144, 415/301, 203, 204, 206; 416/201, 203, 204, 416/206

See application file for complete search history.

(56) References Cited

U.S. PATENT DOCUMENTS

| | | | | |
|---|---|---|---|---|
| 2,684,635 | A | | 7/1954 | Winkelman et al. |
| 2,903,991 | A | | 9/1959 | Carlson et al. |
| 3,751,179 | A | | 8/1973 | Wassmann |
| 3,752,603 | A | | 8/1973 | Bunch |
| 3,851,993 | A | | 12/1974 | Foster |
| 3,861,831 | A | | 1/1975 | Rule |
| 3,910,725 | A | | 10/1975 | Rule |
| 3,947,154 | A | | 3/1976 | Klepp et al. |
| 4,013,383 | A | | 3/1977 | Rule |
| 4,191,240 | A | | 3/1980 | Rule et al. |
| 4,273,562 | A | | 6/1981 | Niskanen |
| 4,468,357 | A | | 8/1984 | Miller et al. |
| 4,747,757 | A | | 5/1988 | Haentjens |
| 4,913,620 | A | | 4/1990 | Kusiak et al. |
| 4,919,591 | A | | 4/1990 | Kamimura et al. |
| 4,964,950 | A | | 10/1990 | Niskanen et al. |
| 4,981,413 | A | * | 1/1991 | Elonen et al. ..... 415/144 |
| 5,104,541 | A | | 4/1992 | Daniel |
| 5,137,424 | A | | 8/1992 | Daniel |
| 5,538,406 | A | | 7/1996 | Siegal et al. |
| 5,582,777 | A | | 12/1996 | Vento |
| 5,632,220 | A | | 5/1997 | Vento |
| 5,720,636 | A | * | 2/1998 | Burg ..... 440/41 |
| 5,782,605 | A | * | 7/1998 | Kohler ..... 415/143 |
| 5,833,437 | A | | 11/1998 | Kurth et al. |
| 5,938,412 | A | | 8/1999 | Izraelev |
| 5,984,644 | A | | 11/1999 | Yu et al. |
| 5,996,977 | A | | 12/1999 | Burgess |
| 6,045,340 | A | | 4/2000 | Batchelder et al. |
| 6,050,550 | A | | 4/2000 | Burgess |

(Continued)

FOREIGN PATENT DOCUMENTS

| | | |
|---|---|---|
| EP | 0 466 167 | 1/1992 |

(Continued)

*Primary Examiner*—Igor Kershteyn
(74) *Attorney, Agent, or Firm*—Price, Heneveld, Cooper, DeWitt & Litton, LLP

(57) ABSTRACT

A pump for a watercraft comprises a housing including a chamber having an inlet, a first outlet, a second outlet, and a first and a second portion, wherein the first outlet is disposed in the first portion of the chamber and the second outlet is disposed in the second portion of the chamber. The inlet is adapted to receive a fluid therethrough, and the first and the second outlets are adapted to simultaneously emit a fluid therethrough. An impeller is disposed in the chamber of the housing and is adapted to induce a flow to a fluid from the inlet to the first and second outlets. The impeller is entirely disposed within the first portion of the chamber, wherein a fluid that is emitted through the second outlet must pass through the first portion of the chamber.

24 Claims, 2 Drawing Sheets

U.S. PATENT DOCUMENTS

| | | | |
|---|---|---|---|
| 6,276,908 | B1 | 8/2001 | Batchelder et al. |
| D455,440 | S | 4/2002 | Yorulmazoglu et al. |
| 6,390,780 | B1 | 5/2002 | Batchelder et al. |
| 6,394,423 | B1 | 5/2002 | Vento |
| 6,461,121 | B1 | 10/2002 | Lelong |
| 6,530,758 | B1 | 3/2003 | Ritter et al. |
| 6,547,539 | B1 | 4/2003 | Izraelev |
| 6,554,587 | B1 | 4/2003 | Paolini et al. |
| 6,655,663 | B1 | 12/2003 | Vento |
| 2003/0133811 | A1 | 7/2003 | Yen |
| 2003/0188772 | A1 | 10/2003 | Jenkins et al. |

FOREIGN PATENT DOCUMENTS

| | | |
|---|---|---|
| EP | 0 953 773 | 11/1999 |
| FR | 2 523 431 | 9/1982 |

* cited by examiner

DUAL OUTLET PORT PUMP

FIELD OF THE INVENTION

The present invention relates to pumps, and more particularly to pumps having dual outlets.

BACKGROUND OF THE INVENTION

Commercial and recreational watercraft typically include one or more onboard pumps which are used for various tasks such as bilge pumping, washdown, bait tanks and the like. These utility pumps circulate fresh and/or salt water, which is often contaminated by particulate materials which can harm or interfere with the operation of the pump. As a result, these utility pumps often become clogged with debris wherein the utility pump may become inoperable. The inoperability of these pumps may become a safety issue, as for example, when the pump is used as a bilge pump, and the pump is employed to remove water and/or other liquids from the inside of the watercraft rendering the watercraft inoperable or worse, hazardous.

Watercraft pumps are also typically installed within areas of the watercraft which do not allow easy access to the pump for various replacement and/or repair procedures. This awkward or inaccessible placement of the pump makes replacement of the pump difficult, costly and time consuming.

Therefore, a need exists for a watercraft pump which is not prone to becoming clogged and one which is easily serviceable and/or replaceable.

SUMMARY OF THE INVENTION

One aspect of the present invention is to provide a pump for a watercraft that includes a housing having a chamber having an inlet, a first outlet, a second outlet, and a first and a second portion, wherein the first outlet is disposed in the first portion of the chamber and the second outlet is disposed in the second portion of the chamber. The inlet is adapted to receive a fluid therethrough and the first and the second outlets are adapted to simultaneously emit a fluid therethrough. An impeller is disposed in the chamber of the housing and is adapted to induce a flow to a fluid from the inlet to the first and second outlets. The impeller is entirely disposed within the first portion of the chamber, wherein a fluid that is emitted through the second outlet must pass through the first portion of the chamber.

Another aspect of the present invention is to provide a pump for a watercraft and comprises a housing including a tubular chamber having an inlet, a first outlet and a second outlet and a first and a second portion, wherein the first outlet is disposed in the first portion of the chamber and the second outlet is disposed in the second portion of the chamber. The first portion is disposed upstream of the second portion. The inlet is adapted to receive a fluid therethrough and the first and the second outlets are adapted to simultaneously emit a fluid therethrough. An impeller is disposed in the first chamber of the housing and is adapted to induce a flow to a fluid from the inlet to the first and second outlets, wherein a fluid that is emitted through the second outlet must pass through the first portion of the chamber, and wherein a select one of the first or the second outlets continues to discharge fluid when the remaining of the select one of the first and second outlets is blocked from discharging of fluid.

Yet another aspect of the present invention is to provide a pump for a watercraft comprising a housing including a tubular chamber having an inlet, a first outlet, a second outlet, and a first and a second portion, wherein the first outlet is disposed in the first portion of the chamber and the second outlet is disposed in the second portion of the chamber. The first portion is disposed below the second portion and the inlet is adapted to receive a fluid therethrough. The first and the second outlets are adapted to simultaneously emit a fluid therethrough. An impeller is disposed in the first chamber of the housing, the impeller being disposed above the inlet and adapted to induce a flow to a fluid from the inlet to the first and second outlets, wherein a fluid that is emitted through the second outlet must pass through the first portion of the chamber.

The present inventive watercraft pump reduces clogging and inoperability, thereby increasing the reliability of the pump and the safety of the associated watercraft.

The pump further is easily serviceable and/or repairable, may be assembled/disassembled without the use of specialized tools, even by unskilled persons, and is particularly well adapted for the proposed use.

These and other features of the invention will be further understood and appreciated by those skilled in the art by reference to the following written specifications, claims and appended drawings.

DETAILED DESCRIPTION OF THE PREFERRED EMBODIMENTS

Figure 1:
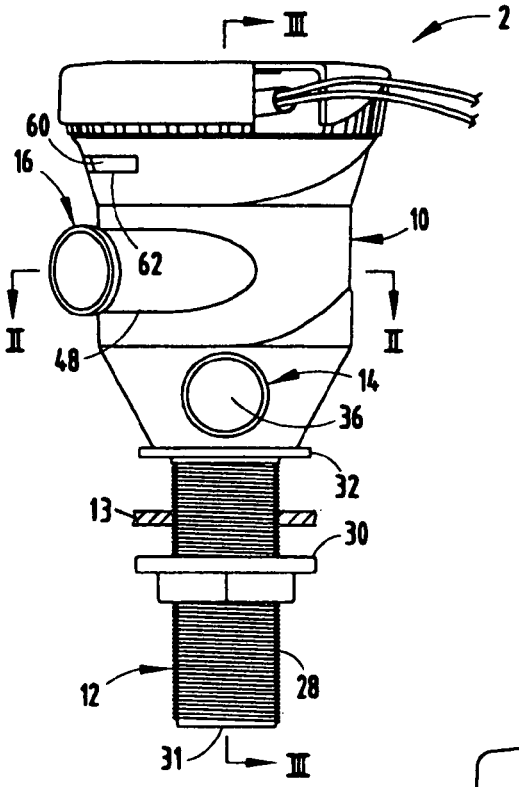
FIG. 1 is a front view of the dual outlet pump according to an embodiment of the present invention.

For the purposes of descriptions herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 2 (FIG. 1) generally designates a watercraft pump embodying the present invention. In the illustrated example, the watercraft pump comprises a housing 10 that includes a chamber 11 having an inlet 12, a first outlet 14 and a second outlet 16, wherein water which is drawn in through the inlet 12, by an impeller 20 is simultaneously discharged through first and second outlets 14, 16, respectively. As described in more detail hereinafter, the impeller 20 is operated by a motor 18 which is removably attached to the housing 10.

Figure 2:
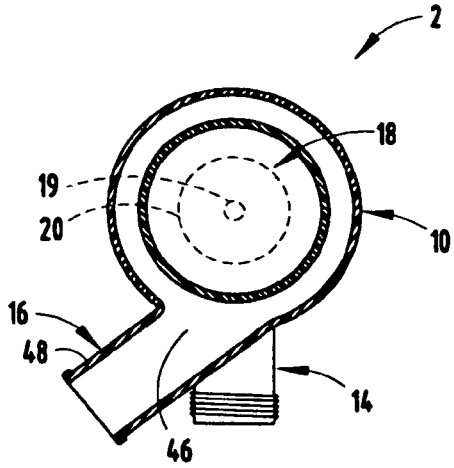
FIG. 2 is a cross-sectional view taken along line II—II of FIG. 1.
Figure 3:
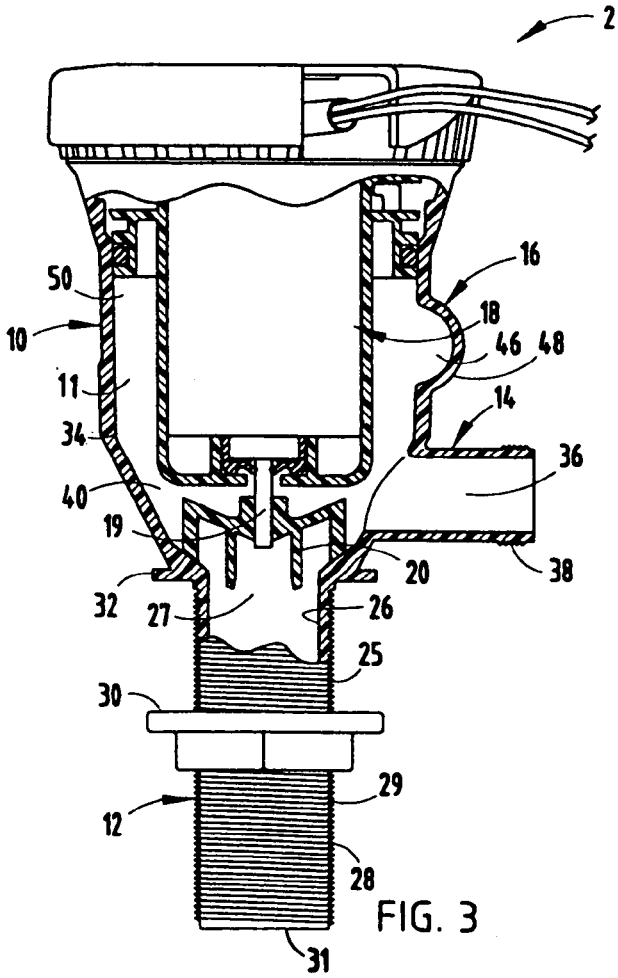
FIG. 3 is a cross-sectional view taken along line III—III of FIG. 1.

The inlet 12 (FIGS. 2 and 3) includes a tube portion 25 having an upwardly located aperture 27 and a downwardlyexposed aperture 31, wherein water or other fluid may be drawn into the housing 10. The inlet 12 includes a generally smooth interior surface 26 and a threaded exterior surface 28 including threads 29. The threads 29 are adapted to receive a nut 30 or other similar retention device that cooperates with a flange 32 to secure the watercraft pump 2 within an associated watercraft as described below.

The first outlet 14 includes an aperture 36, an outwardly-extending extension 38, and is disposed along the periphery of the housing 10 proximate a lower or first portion 40 of the chamber 11. The first portion 40 preferably includes approximately the lower half of the chamber 11 and does not include the tube 25 of the inlet 12. The second outlet 16 includes an aperture 46 and an outwardly-extending extension 48, and is disposed along a periphery of the housing 10 proximate an upper or second portion 50 of the chamber 11. The second portion 50 is disposed upstream of the first portion 40 and generally includes the upper portion of housing 10. The second portion 50 preferably includes approximately the upper half of the chamber 11.

In the illustrated example, the first outlet 14 extends radially outward from the housing 10, whereas the second outlet 16 extends tangentially outwardly. The second outlet 16 is disposed upstream of first outlet 14. The term "upstream" as used herein signifies that the fluid that is discharged from the second outlet 16, disposed in the second portion 50 of the chamber 11, must travel through, across or around the first portion 40. Although other configurations are possible, this fluid flow is preferably accomplished by having the second outlet 16 disposed above the first outlet 14. Moreover, although the first outlet 14 is illustrated as being radially disposed and the second outlet 16 as being tangentially disposed, other alternate configurations are possible such that the first and second outlets 14, 16 may be alternately or together either radially or tangentially disposed.

The housing member 10 is preferably constructed of a thermoplastic, such as XENOY®, a PC/PBT resin available from GE Plastics. However, other suitable materials such as rigid materials capable of withstanding the elements, stresses and/or forces that a watercraft pump would be subjected to may also be utilized. Such materials are commonly known within the art and may include, but are not limited to, thermal plastics, thermosets and elastomers. Although molding compounds have been specifically mentioned, the method of fabricating housing 10 may be varied and although the preferred embodiment is molded, this is not meant to be limiting in any manner as housing 10 may be fabricated from any known method including machining, 3D-layering or the like and from any known material including plastics, metals, ceramics and/or composites thereof. In the illustrated example, the housing 10 includes a one-piece tubular configuration having a relatively smooth interior surface 34, however, the housing 10 may be fabricated from multiple pieces as the specific requirements dictate. Further, the extensions 38 and 48 of the first outlet 14 and the second outlet 16 include ridges and/or threads disposed on the exterior surface for attachment to various accessories and/or hoses.

Figure 4:
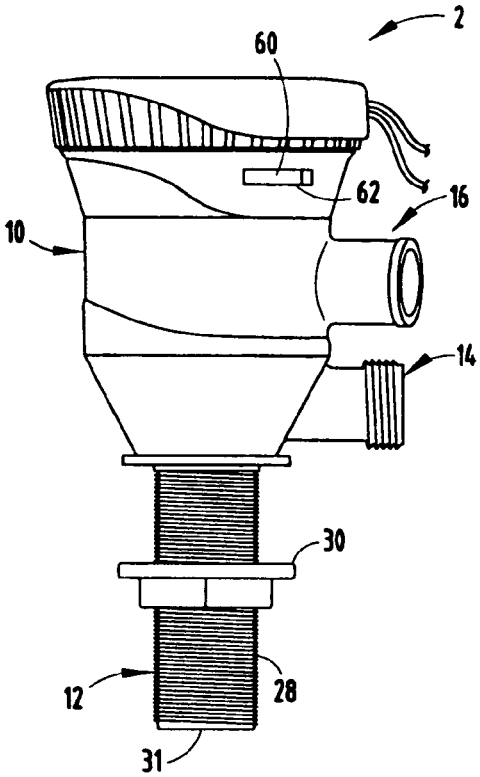
FIG. 4 is a side view of the dual outlet pump of FIG. 1.

Disposed within housing 10 (FIGS. 4 and 5) is the motor 18 which is releasably secured therein through one or more tabs 60 disposed within one or more apertures 62 in the housing 10. The motor 18 rotates the impeller 20 through a shaft or axel 19, thereby inducing a flow of the fluid through the housing 10. The fluid flow is induced when the impeller 20 is rotated, whereby the impeller 20 draws the fluid into the inlet 12, thereby inducing the fluid which surrounds the inlet opening 31 to move upward within the interior surface 26 towards the impeller 20. The impeller 20 emits the fluid to the interior surface 34 of the chamber 11, more specifically to the first portion 40 and then to the second portion 50, thereby moving the fluid disposed within the chamber 11 to and through the outlets 14, 16 simultaneously.

The particular characteristics of the motor 18 and the impeller 20 may be varied according to specific requirements and may take on various configurations and/or alternate embodiments from what is illustrated. In the illustrated example, a nominal 12-volt brush-type DC motor is utilized in conjunction with a single suction, open impeller, and the impeller 20 is disposed within the first portion 40 of the chamber 11 directly above the aperture 27 of the inlet 12.

When the watercraft pump 2 is utilized to pump a fluid other than potable water, particulates may be drawn in through the inlet 12. For example, when the pump 2 is operated as a bilge pump, the water drawn through the inlet 12 may have particles disposed therein which can cause the first or second passage 14, 16, to become blocked. The pump 2 is operable such that the first and second outlet ports 14, 16, are designed to discharge water simultaneously. Therefore, if an obstruction is present which closes one of the outlet port 14, 16, the other outlet port 14, 16 remains free to operate. Consequently, even if one of the outlets become plugged or inoperable, the other outlet remains operable.

Figure 5:
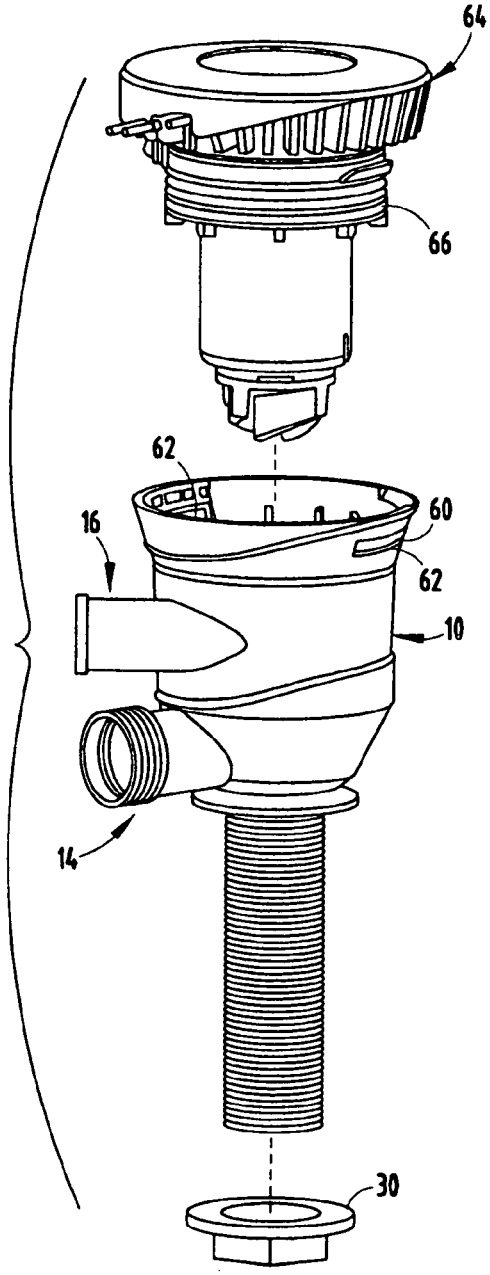
FIG. 5 is an exploded perspective view of the dual outlet pump of FIG. 1 with a motor assembly shown removed from a housing.

As best illustrated by FIG. 5, the motor 18 is attached to the housing 10 through a pair of tabs 60 disposed on a cap portion 64 of the motor 18. The tabs 60 are disposed through a pair of apertures 62 disposed in housing 10, thereby sealingly engaging the motor 18 within the housing 10. As illustrated, an O-ring 66 is used to seal the motor 18 within the housing 10. This mounting configuration of the motor 18 and the housing 10 allows the motor 18 to be removed for servicing and/or replacement, and allows the pump 2 to be routinely cleaned, without requiring the housing 10 and/or the inlet 12 to be removed from the watercraft. The interior of the housing 10 may be accessed by removing the motor 18, thereby gaining access to the interior 34 thereof.

In use, the pump 2 is installed at a specific location on the watercraft by inserting the inlet 12 through an aperture within a floor, wall, hull or other surface 13 of the watercraft, such that the inlet 12 or piping connected thereto (not shown) is submerged in the fluid that is to be pumped. The pump 2 rests on one side of this surface through the flange 32. The nut 30 is threadingly engaged with the threads 29 and is threaded to retain the pump 2 on the watercraft by having the floor, wall, hull or other surface of the watercraft disposed between the flange 32 and the nut 30.

The present inventive watercraft pump reduces clogging and inoperability, thereby increasing the reliability of the pump and the safety of the associated watercraft.

The pump further is easily serviceable and/or repairable, may be assembled/disassembled without the use of specialized tools, even by unskilled persons, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A watercraft, comprising:

a structural member of a watercraft;

a housing operably coupled to the structural member and comprising a chamber having an inlet, a first outlet, a second outlet, a first portion and a second portion, the first outlet disposed in the first portion of the chamber and the second outlet disposed in the second portion of the chamber, the inlet adapted to receive a fluid therethrough, and the first and the second outlets adapted to simultaneously emit a fluid therethrough; and an impeller entirely disposed within the first portion of the chamber and adapted to induce a flow to a fluid from the inlet to the first and second outlets, and wherein a fluid that is emitted through the second outlet must pass through the first portion of the chamber.

2. The watercraft according to claim 1, wherein the housing further comprises a cylindrically shaped interior, wherein the first outlet is radially disposed and the second outlet is tangentially disposed.

3. The watercraft according to claim 1, wherein the inlet comprises a cylindrical tubular body comprising a threaded exterior surface.

4. The watercraft according to claim 3, wherein the tubular body of the inlet further comprises a flange disposed along the exterior surface.

5. The watercraft according to claim 1, wherein the housing further comprises a removable motor assembly that is adapted to rotate the impeller.

6. The watercraft according to claim 5, wherein the motor assembly comprises a tab which is removably attached to a slot disposed in the housing.

7. The watercraft according to claim 5, wherein the housing further comprises an open top, and wherein the motor assembly is removable from the open top of the housing.

8. The watercraft according to claim 1, wherein at least one of the first and the second outlets comprises an outlet port extending outwardly from the housing and includes a threaded exterior surface.

9. The watercraft, comprising:

a structural member for a watercraft;

a housing operably coupled to the structural member and comprising a tubular chamber having an inlet, a first outlet and a second outlet, a first portion and a second portion, the first outlet disposed in the first portion of the chamber and the second outlet disposed in the second portion of the chamber, the first portion disposed upstream of the second portion, the inlet adapted to receive a fluid therethrough, and the first and the second outlets adapted to simultaneously emit a fluid therethrough; and an impeller disposed in the first portion of the chamber of the housing and adapted to induce a flow to a fluid from the inlet to the first and second outlets, wherein a fluid that is emitted through the second outlet must pass through the first portion of the chamber and wherein a select one of the first and the second outlets continues to discharge fluid when the remaining of the select one of the first and the second outlets is blocked from discharging fluid.

10. The watercraft according to claim 9, wherein the housing further comprises a cylindrically shaped interior wherein the first outlet is radially disposed and the second outlet is tangentially disposed.

11. The watercraft according to claim 9, wherein the inlet comprises a cylindrical tubular body comprising a threaded exterior surface.

12. The watercraft according to claim 11, wherein the tubular body of the inlet further comprises a flange disposed along the exterior surface.

13. The watercraft according to claim 9, wherein the housing includes a removable motor assembly that is adapted to rotate the impeller.

14. The watercraft according to claim 13, wherein the motor assembly includes a tab which is removably attached to a slot disposed in the housing.

15. The watercraft according to claim 13, wherein the housing further comprises an open top, and wherein the motor assembly is removable from the open top of the housing.

16. The watercraft according to claim 9, wherein at least one of the first and the second outlets comprises an outlet port extending outwardly from the housing and includes a threaded exterior surface.

17. A watercraft, comprising:

a structural member of a watercraft;

a housing operably coupled to the structural member comprising a tubular chamber having an inlet, a first outlet and a second outlet, a first portion and a second portion, the first outlet disposed in the first portion of the chamber and the second outlet disposed in the second portion of the chamber, the first portion disposed below the second portion, the inlet adapted to receive a fluid therethrough, and the first and the second outlets adapted to simultaneously emit a fluid therethrough; and an impeller disposed in the first portion of the chamber of the housing and above the inlet and adapted to induce a flow to a fluid from the inlet to the first and second outlets, and wherein a fluid that is emitted through the second outlet must pass through the first portion of the chamber.

18. The watercraft according to claim 17, wherein the housing further includes a cylindrically shaped interior, and wherein the first outlet is radially disposed and the second outlet is tangentially disposed.

19. The watercraft according to claim 18, wherein the inlet comprises a cylindrical tubular body comprising a threaded exterior surface.

20. The watercraft according to claim 19, wherein the tubular body of the inlet further comprises a flange disposed along the exterior surface.

21. The watercraft according to claim 19, wherein the housing further comprises a removable motor assembly that is adapted to rotate the impeller.

22. The watercraft according to claim 21, wherein the motor assembly includes a tab which is removably attached to a slot disposed in the housing.

23. The watercraft according to claim 22, wherein the housing further comprises an open top, and wherein the motor assembly is removable from the open top of the housing.

24. The watercraft according to claim 23, wherein at least one of the first and the second outlets comprises an outlet port extending outwardly from the housing and includes a threaded exterior surface.

* * * * *